United States Patent [19]

Sugizaki

[11] Patent Number: 5,027,565

[45] Date of Patent: Jul. 2, 1991

[54] OPENABLE ROOF

[75] Inventor: Kenichi Sugizaki, Tokyo, Japan

[73] Assignee: Shimizu Construction Co., Ltd., Japan

[21] Appl. No.: 567,137

[22] Filed: Aug. 14, 1990

[30] Foreign Application Priority Data

Aug. 16, 1989 [JP] Japan ..... 1-211176

[51] Int. Cl.[5] ..... E04B 7/16

[52] U.S. Cl. ..... 52/6; 52/65; 52/67

[58] Field of Search ..... 52/6, 7, 8, 9, 80, 81, 52/65, 67

[56] References Cited

U.S. PATENT DOCUMENTS 4,738,057 4/1988 Logan ..... 52/6

*Primary Examiner*—John E. Murtagh

*Attorney, Agent, or Firm*—Scully, Scott, Murphy & Presser

[57] ABSTRACT

An openable roof includes a plurality of rotationally movable roof members and at least one linearly movable roof member. Each of the rotationally movable roof members is of a generally sectorial shape in a two-dimensional projection. The sectorial shape has a radially outer edge portion. The outer edge portions of the rotationally movable roof members are movably disposed on an outer arcuate support. Accordingly, each of the rotationally movable roof members is able to revolve around an axis of the arcuate support so as to participate to open and close a sectorial opening portion provided by the arcuate support. The linearly movable roof member has a generally V-shaped edge portion. The V-shaped edge portion cooperates with the arcuate support to define the sectorial opening. The linearly movable roof member is movably disposed on a plurality of linear supports so as to participate to open and close a larger opening portion which is larger than the sectorial opening.

7 Claims, 3 Drawing Sheets

OPENABLE ROOF

BACKGROUND OF THE INVENTION

The present invention relates to an openable roof comprising a plurality of slidable (movable) roof members which are of partially sectorial shape when viewed from above, and which are arcuately movable along a prescribed arcuate path about a central axis of rotation. The openable roof may be preferable used for a structure having a large internal space, for example, a stadium.

In compliance with the duty of disclosure, the present applicant discloses four U.S. patent applications Ser. Nos. 7/439,302, 07/502,170, 07/502,613, and 07,523,720.

Openable roofs are highly desirable as they provide sunlight, fresh air, and a sense of freedom when open, while protecting the interior from adverse weather when closed. To this end, various types of openable roofs were previously proposed and developed.

However, most of these openable roofs exhibit one or more of the following problems:

The configurations of the movable roof members and the travelling mechanisms for travelling the members are complicated. In openable roofs, the portion of the opening is necessarily narrow, and the support for supporting the movable roof members must withstand a highly concentrated load from the movable roof members. In addition, since most openable roof comprise large-scale movable roof members, the travelling paths of the movable roof members are extremely long. The changes of the locations of the centers of gravity of the movable roof members are very large. Accordingly, the stability of the movable roof members in transit is necessarily low.

SUMMARY OF THE INVENTION

It is therefore an object of the present invention to provide an openable roof wherein the stability of the movable roof members is improved when travelling.

It is another object of the present invention to provide an openable roof wherein the configurations of the movable roof members, and the travelling mechanisms for travelling the members, are simplified.

In order to achieve the above objects, the openable roof in one aspect of the invention includes a plurality of rotationally movable roof members and at least one linearly movable roof member. Each of the rotationally movable roof members is of a generally sectorial shape in a two-dimensional projection. The sectorial shape has a radial outer edge portion The outer edge portions of the rotationally movable roof members are movably disposed on an outer arcuate support Accordingly, each of the rotationally movable roof members is able to revolve around an axis of the arcuate support so as to participate to open and close a sectorial opening portion provided by the arcuate support. The linearly movable roof member has a generally V-shaped edge portion. The V-shaped edge portion cooperates with the arcuate support to define the sectorial opening. The linearly movable roof member is movably disposed on a plurality of linear supports so as to participate to open and close a larger opening portion which is larger than the sectorial opening.

With such a construction, since the linearly movable roof member is supported on the plurality of linear tracks, the stability of the linear movable roof member when travelling is improved.

Additionally, since the rotationally movable roof members are disposed on the arcuate support, the load from the movable roof members is effectively distributed on the tracks. Consequently, the stability of the whole roof structure can be improved.

Furthermore, the storing areas for storing the rotationally movable roof members can be relatively decreased since a plurality of the movable roof members is provided That is, the plurality of rotationally movable roof members are overlapped one on the other. Accordingly, the arcuate distances on which the rotationally movable roof members travel can be made compact. Since the changes of the locations of the centers of the gravity of the movable roof members are small, the stability of the movable roof members when travelling can be improved.

Moreover, since the plurality of rotationally movable roof members are provided and the linearly movable roof member is provided, the configuration of the rotationally movable roof members, and the travelling mechanisms for travelling the members can be simplified and compacted. Accordingly, the cost for constructing the roof members and the travelling mechanisms is decreased.

Preferably, the openable roof comprises at least one fixed roof member which is disposed at a side of the larger opening. The fixed roof member defines the opening portion of a V-shape. The linear supports are disposed on the fixed roof member. The linearly movable roof member is able to store the rotationally movable roof members, so that all of the linearly and rotationally movable roof members are able to be stored over and/or under the fixed roof member when the roof is open.

Since the movable roof members are stored over and/or under the fixed roof member when the roof is open, the opening portion is broader than that of conventional openable roofs. This allows the audience seat in the stadium to experience a greater sense of freedom.

More preferably, each of the fixed roof member and linearly and rotationally movable roof members comprises a section of a sphere, with a subsection removed, so that the entire openable roof is dome-shaped when the roof is closed.

More preferably, the linearly movable roof member comprises a center support having said center axis. All of the rotationally movable roof members are also supported by the center support are able to rotate about the center support.

More preferably, a plurality of drive means are provided under the outer edge portions of the linearly and rotationally movable roof members whereby the linearly movable roof member is movably supported on the linear supports via the drive means, and the rotationally movable roof members are movably and drivingly supported on the arcuate supports via the drive means.

DETAILED DESCRIPTION OF THE PREFERRED EMBODIMENTS

Figure 1:
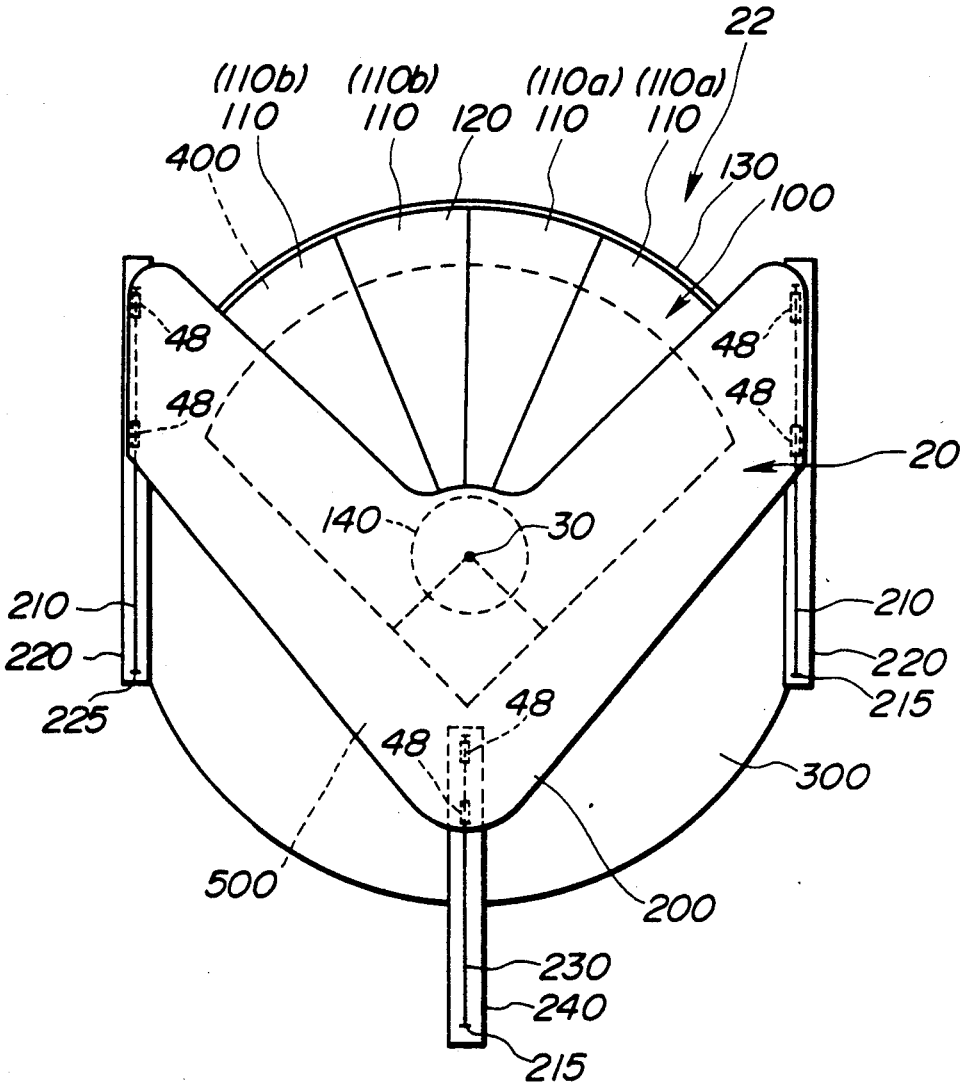
FIG. 1 is a plan view of an openable roof according to an embodiment of the present invention, showing the roof in the closed configuration.

With reference to the accompanying drawings, preferred embodiments of the present invention will be described in detail hereinafter.

An openable roof 20 aCcording to an embodiment is represented in FIGS. 1 through 4. As shown in FIGS. 1 through 4, the openable roof 20 is disposed on a multipurpose stadium 22 in which baseball games may be played, concerts performed, and so on.

The openable roof 20 is of a generally circular shape in plan view when the roof is closed. The openable roof 20 comprises rotationally movable roof members unit 100, a generally V-shaped, linearly movable roof member 200 and a generally U-shaped, fixed roof member 300. The rotationally movable roof members unit 100 is of a generally sectorial shape in plan view.

When the roof 20 is closed, the rotationally movable roof members unit 100 mainly covers the outfield and the outfield stand 400 of the stadium 22. The linearly movable roof member 200 mainly covers the infield of the stadium 22. The fixed roof member 300 covers the infield stand 500 of the stadium 22.

The rotationally movable roof members unit 100 comprises four separated rotationally movable roof members 110. Each of the rotationally movable roof members 110 is also of a partially sectorial shape in plan view, so that the roof members 110 cooperate to close off the central portion of the stadium 22 from the outer environment.

Each of the rotationally movable roof members 110, the linearly movable roof members 200, and the fixed roof member 300, is of an arc shape in side view (FIGS. 3 and 4), so that the openable roof 20 is of a dome shape, that is, generally a portion of a sphere when the roof 20 is closed.

Figure 2:
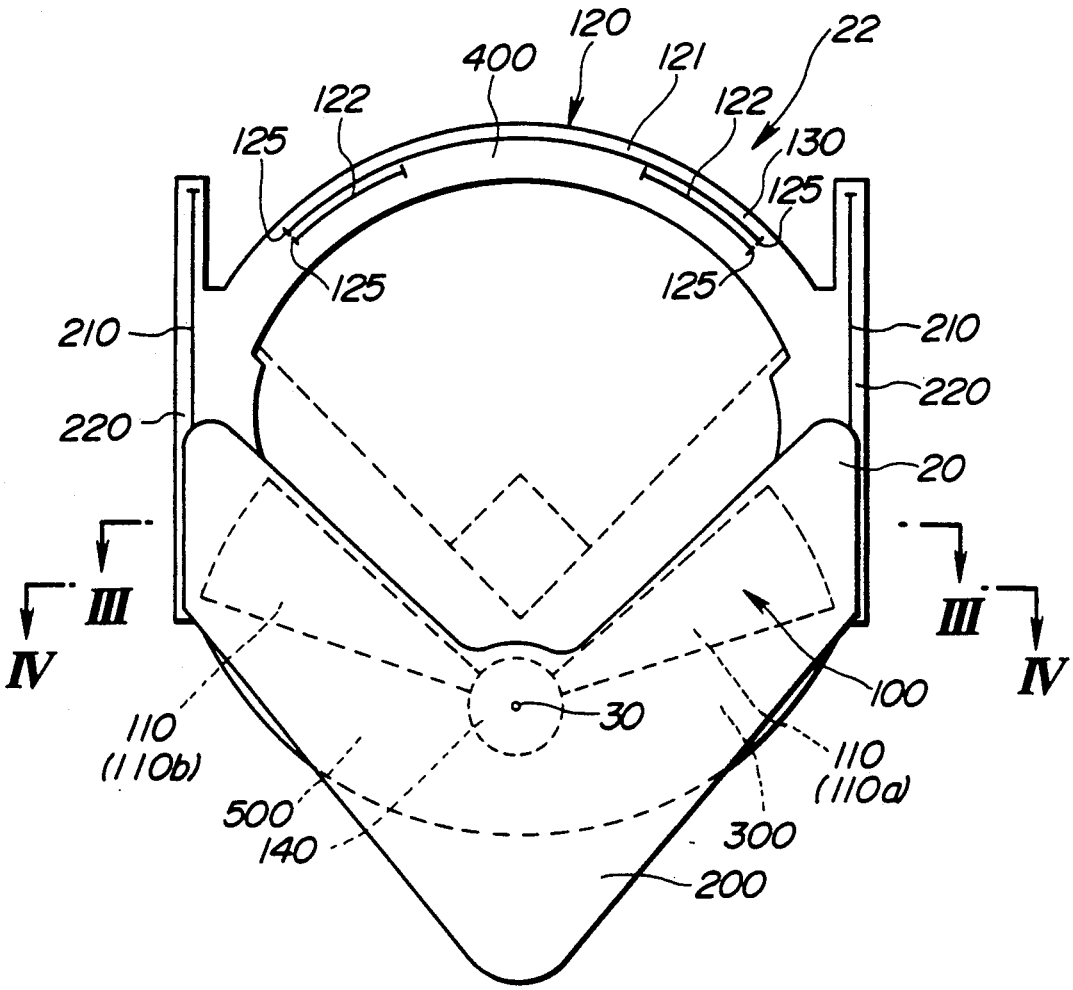
FIG. 2 is a plan view of the openable roof in FIG. 1, when the roof is in the open configuration.

As shown in FIGS. 1 and 2, the generally U-shaped fixed roof member 300 is disposed on both of the sides (right and left wings) of the stadium 22 so as to cover the infield stand 500 of the stadium 22. When the roof 20 is closed off, the rotationally movable roof members 110 and the linearly movable roof member 200 intermediate between both sides of the U-shaped fixed roof member 300. For clarity, the rotationally movable roof members 110 are classified into a pair of right wing rotationally movable roof members **110*a* and a pair of left wing rotationally movable roof members 110*b***.

In FIG. 1, the right wing rotationally movable roof members **110*a* and the left wing rotationally movable roof members 110*b* are symmetrically disposed about the center line of the stadium 22. Each of the rotationally movable roof members 110 is slidably turned about the center axis 30 of the sectorial shape of the rotationally movable roof unit 100. Therefore, both the right wing rotationally movable roof members 110*a* are lapped over the right wing side of the fixed roof member 300 when the roof 20 is closed off as shown in FIG. 2. Similarly, both the left wing rotationally movable roof members 110*b* are lapped over the left wing side of the fixed roof member 300**.

Figure 6:
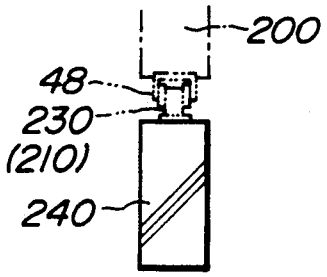
FIG. 6 is a side elevational view of the travelling mechanism applied to the embodiment shown in FIG. 1.

On the fixed roof member 300, linear supports 220 and 240 are disposed parallel to one another. The linearly movable roof member 200 is disposed and supported on the supports 220 and 240. A rail-like linear track 210 or 230 is installed on each of the linear supports 220 and 240 and continuously along the supports 220 and 240. A plurality of electrically driven wheels 48, for example, servo-linear-motor-driven wheels, are connected to the lower surface of the linearly movable roof member 200 and drivingly disposed on the tracks 210 and 230 of the linear supports 220 and 240 as shown in FIG. 6. Thus, the linearly movable roof member 200 is slidable in a horizontal direction, and supported on the tracks 210 and 230 via the electrically driven wheels 48.

As shown in FIGS. 1 and 2, the rotationally movable roof members 110 are supported on an arcuate support 130 and a center support 140. The arcuate support 130 is disposed in a horizontal plane, and is disposed on the wall of the stadium 22. The arcuate support 130 and the center support 140 are concentrically disposed in such a fashion that the above-mentioned center axis 30 is the common center of the profiles of the supports 130 and 140.

Figure 3:
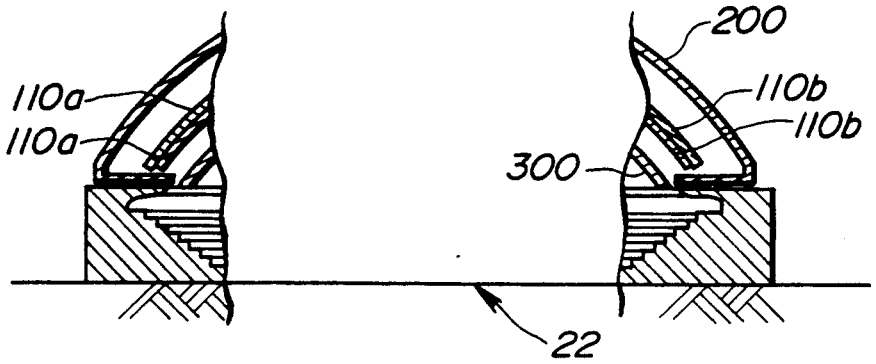
FIG. 3 is a side elevational view of the openable roof in FIG. 1, showing an elevation indicated by line III—III in FIG. 2.
Figure 4:
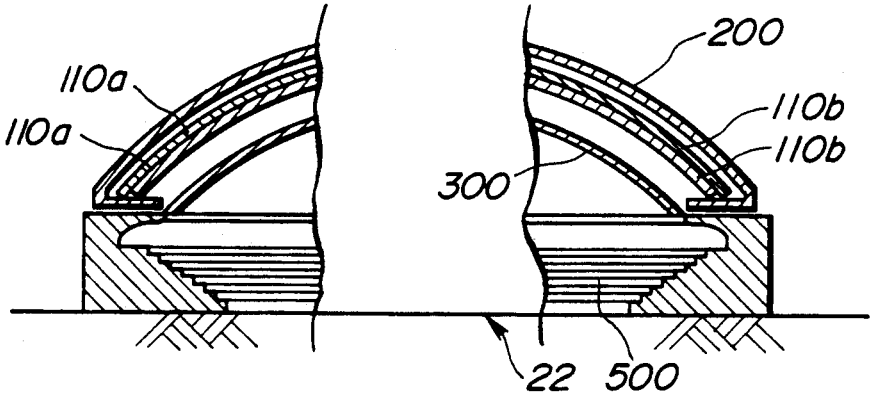
FIG. 4 is a side elevational view of the openable roof in FIG. 1, showing an elevation indicated by line IV—IV in FIG. 2.

The center support 140 is disposed on the lower surface of the central portion of the linearly movable roof member 200. The radially outer arcuate edge of the rotationally movable roof members 110 are slidably disposed on the arcuate support 130. Accordingly, the rotationally movable roof members 110 can perform their own turning motions As best shown in FIGS. 3 and 4, the shape of each of the roof members 110, 200, and 300 is a portion of a sphere, the outer surface of which forms a generally continuous smooth curved surface when the roof is closed. However, the imaginary diameters of the roof members are slightly different from one another. That is, the imaginary diameter of the fixed roof member 300 is the shortest since the movable roof members 110 and 200 are stored over the fixed roof member 300 when the roof 20 is open.

In order to clarify the naming of the roof members, the rotationally movable roof members **110*a* and 110*b* are classified into central movable roof members, and side movable roof members hereinafter. The central movable roof members 110*a* and 110*b* may cover the central part of the stadium 22. The side movable roof members 110*a* and 110*b* may cover the sides of the stadium 22**.

The central right wing and left wing movable roof members **110*a* and 110*b* have the same imaginary diameter. The side right wing and left wing movable roof members 110*a* and 110*b* have the same imaginary diameter. The imaginary diameter of the central movable roof members 110*a* and 110*b* is greater than that of the side movable roof members 110*a* and 110*b*, so that the travelling paths of the central and side movable roof members 110*a* and 110*a* do not intersect each other, and in addition, 110*b* and 110*b* do not interfere with the movement of each other. Consequently, the central movable roof members 110*a* and 110*b* are disposed over the side movable roof members 110*a* and 110*b* when the roof 20** is open.

The imaginary diameter of the linearly movable roof member 200 is the greatest since the rotationally movable roof members 110 are stored under the linearly movable roof member 200 when the roof 20 is open.

Rail-like tracks 121 and 122 are installed on the surface of the arcuate support 130, and along the support 130. The track 121 is continuously disposed, and radially outward of the tracks 122 which are symmetrically disposed.

A plurality of electrically driven wheels 48 are also connected to the lower surfaces of the arcuate edges of the rotationally movable roof members 110, and drivingly disposed on the tracks 121 and 122 of the arcuate supports 130 in a manner similar to that in FIG. 6.

The central rotationally movable roof members 110 are slidably supported on the continuous track 121 via the electrically driven wheels 48. The side rotationally movable roof members 110 are also slidably supported on the tracks 122, respectively, in order to avoid interference between the central and side rotationally movable roof members.

Next, the operation and function of the above-described openable roof 20 will be explained.

As shown in FIG. 1, when the roof 20 is closed, the central rotationally movable roof 110*a* and 110*b* are symmetrically disposed above the center portion of the outfield and the outfield stand 400 of the stadium 22. The side rotationally movable roof members 110*a* and 110*b* are symmetrically disposed above the relative sides of the outfield and the outfield stand 400 of the stadium 22. The linearly movable roof member 200 is disposed above the right and left wing@of the outfield and infield. The fixed roof member 300 is always disposed above the right and left wings of the infield stand 500. Therefore, the interior area of the stadium 22 is closed off.

In order to open the roof 20, the right wing rotationally movable roof members 110*a* are respectively traveled along their own paths, by means of the drive for the wheels 48. The rotational motion of the movable roof members 110*a* is stopped when the roof members 110*a* reach the rightmost points 125 of the tracks 121 and 122. Accordingly, the right wing rotationally movable roof members 110*a* are disposed and stored under the right wing of the linearly movable roof member 200. Similarly, the left wing rotationally movable roof members 110*b* are disposed and stored under the left wing of the linearly movable roof member 200 at the left-most points 125. Thus, an open area defined by right and left wings of the linearly movable roof member 200 is opened, exposing the interior.

Next, the linearly movable roof member 200 commences horizontal linear motion along the tracks 210 and 230 toward the back of the stadium 22. The linear motion of the movable roof member 200 is stopped when the roof member 200 reach the rear-most points 215 and 225 of the tracks 210 and 230. Accordingly, all the movable roof members 110 and 200 are disposed and stored over the fixed roof member 300. Thus, an open area defined by the fixed roof member 300 is opened, exposing the interior as shown in FIG. 2.

When closing off the movable roof, the reverse motions of the movable roof members 110 and 300 may be performed.

With such a construction, since the linearly movable roof member 200 is supported on the center and side tracks 230 and 210, the stability of the movable roof member 200 when travelling is improved. That is, the movable roof member 200 is supported on the side tracks 210 as well as the center track 230.

Since the width or the horizontal angle of the rotationally movable roof members 110 are designed to be the same in this embodiment, the configuration of the central and side rotationally movable roof members 110*a* and 110*b*, and the travelling mechanisms (including the tracks 121 and 122 and the electrically driven wheels 48) for travelling the members can be simplified and compacted. Accordingly, the cost for constructing the roof members and the travelling mechanisms is decreased.

In addition, since the movable roof members 110 and 200 are stored over the fixed roof member 300 when the roof 20 is open, the portion of the opening is broader than that of conventional openable roofs. This allows the audience seat in the stadium to experience a greater sense of freedom.

Additionally, since the rotationally movable roof members 110 are disposed on the arcuate tracks 121 and 122, the load from the movable roof members 110 is effectively distributed on the tracks. Consequently, the stability of the whole roof structure 20 can be improved.

Furthermore, the storing areas for storing the rotationally movable roof members 110 can be relatively decreased since a plurality of the movable roof members 110 is provided. That is, the plurality of rotationally movable roof members 110 are overlapped one on the other. Accordingly, the arcuate distances on which the rotationally movable roof members 110 travel can be made compact. Since the changes of the locations of the centers of the gravity of the movable roof members 110 are small, the stability of the movable roof members 110 when travelling can be improved.

Although a preferred embodiment of the present invention is described hereinbefore, it is not intended that the present invention be limited to the first embodiment. Other embodiments based on the spirit and object of the invention will be described in the following description.

For example, the number of the rotationally movable roof members 110 may be increased or decreased; the number of the linear tracks 210 and 230 may be increased; and the locations of the linear tracks can be changed.

Figure 5:
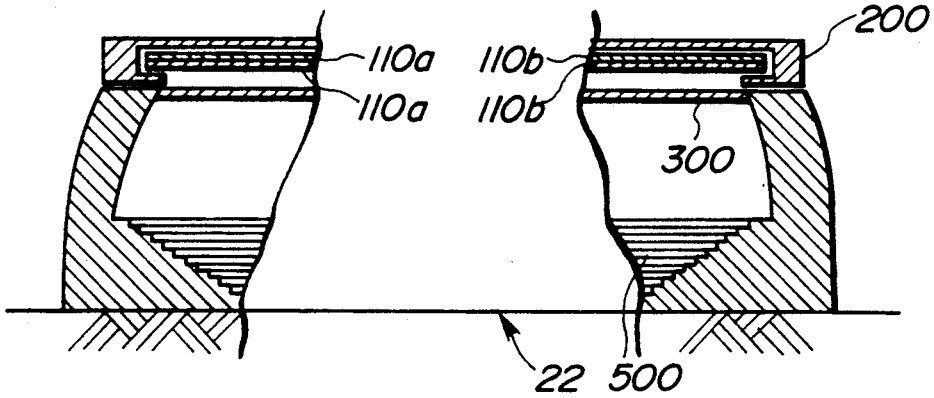
FIG. 5 is a side elevational view of a modification of the openable in FIG. 1, viewed as in FIG. 3.

FIG. 5 depicts a modification of the above embodiment. In the above embodiment, the roof 20 is dome-shaped. However, in FIG. 5, the roof 20 comprising the linearly movable roof members 110, the linearly movable roof member 200, and the fixed roof member 300 are formed in a generally horizontal plane. In this modification, the arcuate support 140 and the side linear support 220 would be at an elevated position.

What is claimed is:

1. An openable roof comprising:

a plurality of rotationally movable roof means, each of which is of a generally sectorial shape in a two-dimensional projection, the sectional shape having a radial outer edge portion, the outer edge portion of the rotationally movable roof means being movably disposed on an outer arcuate support, whereby each of the rotationally movable roof means is able to revolve around an axis of the arcuate support so as to participate to open and close a sectorial opening portion provided by the arcuate support;

at least one linearly movable roof means, the linearly movable roof means having a generally V-shaped edge portion, the V-shaped edge portion cooperating with the arcuate support to define the sectorial opening, the linearly movable roof means being movably disposed on a plurality of linear supports so as to participate to open and close a larger opening portion which is larger than the sectorial opening; and at least one fixed roof means disposed at a side of the larger opening, the fixed roof means defining the opening portion of a V-shape, the linear supports being disposed on the fixed roof means, the linearly movable roof means being able to store the rotationally movable roof means, so that all of the linearly and rotationally movable roof means are able to be stored over and/or under the fixed roof means when the roof is opened.

2. An openable roof as recited in claim 1, wherein each of the fixed roof means and linearly and rotationally movable roof means comprises a section of a sphere, with a subsection removed, so that the entire openable roof is dome-shaped when the roof is closed.

3. An openable roof as recited in claim 1, wherein the linearly movable roof means comprises a center support having said center axis, all of the rotationally movable roof means being also supported by the center support and being able to rotate about the center support.

4. An openable roof as recited in claim 1, wherein a plurality of drive means are provided under the outer edge portions of the linearly and rotationally movable roof means whereby the linearly movable roof means is movably supported on the linear supports via the drive means, and the rotationally movable roof means are movably and drivingly supported on the arcuate supports via the drive means.

5. A structure comprising the openable roof as recited in claim 1.

6. A structure according to claim 5, further comprises a wall on which the arcuate support is disposed.

7. An openable roof as recited in claim 1, wherein the plurality of linear supports includes at least three linear supports disposed on the fixed roof means and along which the linearly movable roof means moves; and said three linear supports are disposed on first and second sides and a center portion of the fixed roof means, so as to be equally spaced from and parallel to one another.

* * * * *

UNITED STATES PATENT AND TRADEMARK OFFICE

CERTIFICATE OF CORRECTION

PATENT NO. : 5,027,565

DATED : July 2, 1991

INVENTOR(S) : Kenichi Sugizaki, et al.

It is certified that error appears in the above-identified patent and that said Letters Patent is hereby corrected as shown below:

Column 1, line 15: "7/439,302" should read as --07/439,302--

Column 1, line 53: "portion" should read as --portion.--

Column 1, line 55: "support" should read as --support.--

Column 2, line 11: "provided" should read as --provided.--

Column 3, line 8: "openable in" should read as --openable roof in--

Column 3, line 17: "aCcording" should read as --according--

Column 4, line 34: "motions" should read as --motions.--

Column 5, line 30: delete "@"

Signed and Sealed this

Fifth Day of January, 1993

*Attest:*

DOUGLAS B. COMER

*Attesting Officer*

*Acting Commissioner of Patents and Trademarks*